US010150288B2

(12) United States Patent
Ogasahara

(10) Patent No.: US 10,150,288 B2
(45) Date of Patent: Dec. 11, 2018

(54) INKJET RECORDING APPARATUS

(71) Applicant: KYOCERA Document Solutions Inc., Osaka (JP)

(72) Inventor: Okito Ogasahara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/874,574

(22) Filed: Jan. 18, 2018

(65) Prior Publication Data

US 2018/0207929 A1 Jul. 26, 2018

(30) Foreign Application Priority Data

Jan. 24, 2017 (JP) ..... 2017-010354

(51) Int. Cl.
*B41J 2/045* (2006.01)
*B41J 11/00* (2006.01)

(52) U.S. Cl.
CPC ..... *B41J 2/04508* (2013.01); *B41J 2/04586* (2013.01); *B41J 11/0085* (2013.01); *B41J 11/0095* (2013.01)

(58) Field of Classification Search
CPC ..... B41J 2/04508; B41J 2/04586; B41J 11/0095; B41J 11/0085
See application file for complete search history.

(56) References Cited

U.S. PATENT DOCUMENTS 9,067,438 B2 * 6/2015 Soda ..... B41J 11/0085

FOREIGN PATENT DOCUMENTS

JP 2013-86425 A 5/2013

* cited by examiner

*Primary Examiner* — Thinh H Nguyen
(74) *Attorney, Agent, or Firm* — Stein IP, LLC

(57) ABSTRACT

An inkjet recording apparatus includes a conveyance section, a conveyance belt, a recording section, a suction fan, a current detection section, a recording-medium detection section, and a control section. After passage of a predetermined time since detection of presence of a recording medium performed by the recording-medium detection section, the control section makes a judgment on whether a drive current applied to the suction fan detected by the current detection section exceeds a first threshold value determined in advance, and in a case where the drive current applied to the suction fan does not exceed the first threshold value, the control section prohibits the recording section from ejecting ink.

5 Claims, 6 Drawing Sheets

INKJET RECORDING APPARATUS

INCORPORATION BY REFERENCE

This application is based upon and claims the benefit of priority from the corresponding Japanese Patent Application No. 2017-010354 filed on Jan. 24, 2017, the entire contents of which are incorporated herein by reference.

BACKGROUND

The present disclosure relates to an inkjet recording apparatus.

As image forming apparatuses, such as copiers and printers, inkjet recording apparatuses have been widely spread in recent years. Inkjet recording apparatuses can be classified into those of a serial type, in which recording is performed while a recording head is scanning across a recording medium such as a sheet, and those of a line-head type, in which recording is performed by a recording head fixed to the apparatus main body.

In an inkjet recording apparatus, if a curl (warp) occurs in a recording medium, when under conveyance, the recording medium may be caught immediately before reaching a recording head to cause a jam. In such a case, ink may be ejected when the recording head has not yet reached where a recording head is arranged, soiling the recording-medium conveyance path. Another concern here is that the curled recording medium may touch an ink ejection nozzle and damage the nozzle. There is known a conventional technology relating to inkjet recording apparatuses devised for the purpose of solving such problems relating to conveyance of a recording medium.

An image forming apparatus relating to the conventional technology includes a conveyance belt which conveys a recording medium in an ink ejection region, a suction fan which causes a recording medium to be adsorbed onto the conveyance belt, and drive current detecting means which detects a drive current applied to the suction fan. When the drive current applied to the suction fan increases as a result of suction holes formed in the conveyance belt being covered with a recording medium, the image forming apparatus detects the increase of the drive current and further raises a drive voltage applied to the suction fan. Thereby, it is possible to convey a recording medium while preventing positional deviation and floating of the recording medium.

SUMMARY

According to an aspect of the present disclosure, an inkjet recording apparatus includes a conveyance section, a conveyance belt, a recording section, a suction fan, a current detection section, a recording-medium detection section, and a control section. The conveyance section has the conveyance belt provided with a plurality of suction holes used for adsorbing a recording medium thereon and movable in a recording-medium conveyance direction, and thereby conveys the recording medium. The recording section is disposed to face the recording medium conveyed by the conveyance section, and ejects ink onto the recording medium. The suction fan is disposed facing a surface of the conveyance belt opposite from a recording-medium conveyance surface of the conveyance belt, and sucks in air via the suction holes to thereby cause the recording medium to be adsorbed on the conveyance belt. The current detection section detects a drive current applied to the suction fan. The recording-medium detection section is disposed on an upstream side of the conveyance section with respect to the recording-medium conveyance direction, and detects presence/absence of the recording medium. The control section controls operations of the conveyance section, the recording section, and the suction fan. Also, after passage of a predetermined time since detection of presence of the recording medium performed by the recording-medium detection section, the control section makes a judgment on whether a drive current detected by the current detection section exceeds a first threshold value determined in advance, and in a case where the drive current does not exceed the first threshold value, the control section prohibits the recording section from ejecting ink.

DETAILED DESCRIPTION

Embodiments of the present disclosure will be described below with reference to the accompanying drawings. The present disclosure is not limited to what is specifically mentioned below.

First Embodiment

Figure 1:
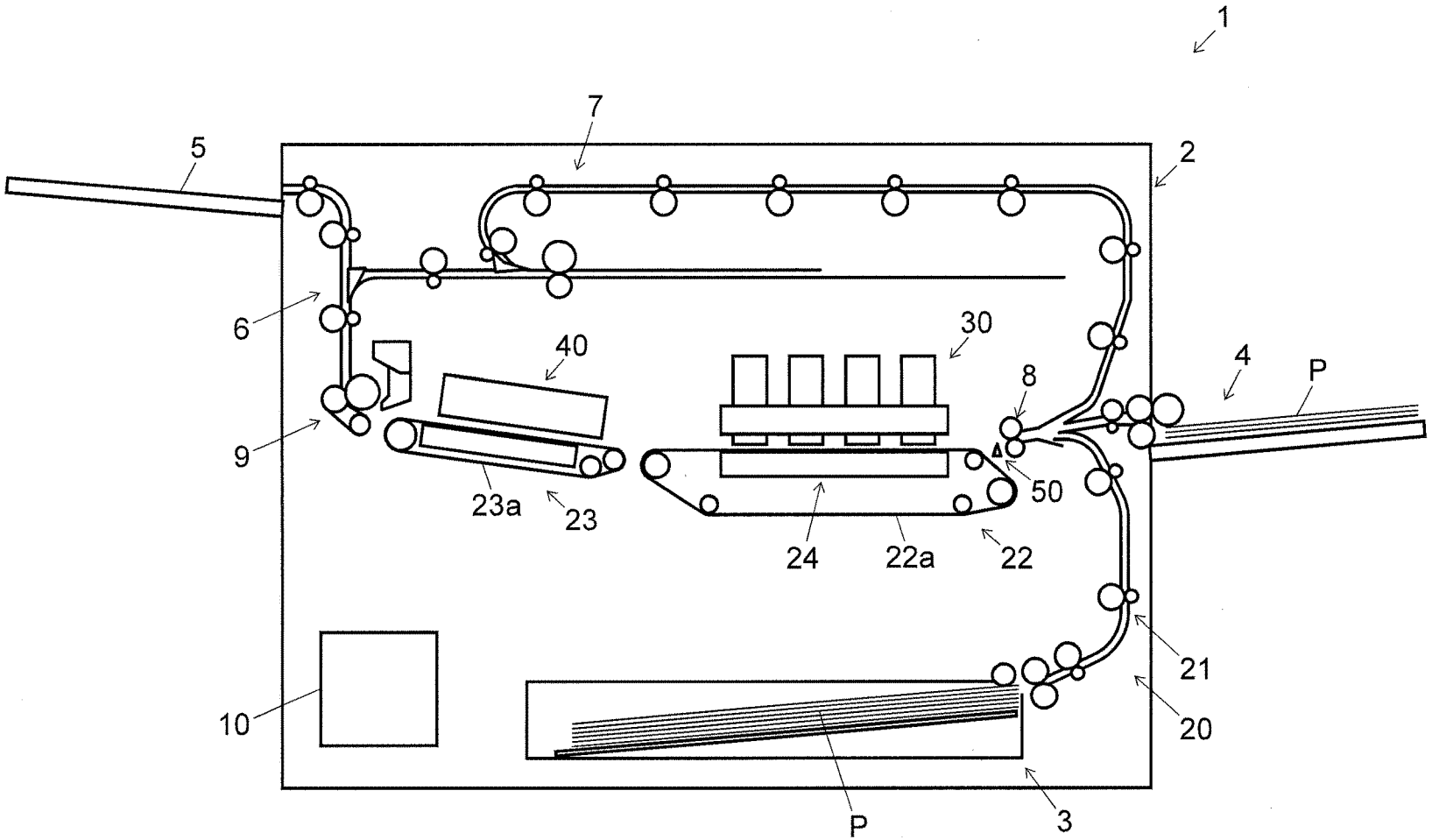
FIG. 1 is a front vertical sectional view of an inkjet recording apparatus according to a first embodiment of the present disclosure.
Figure 2:
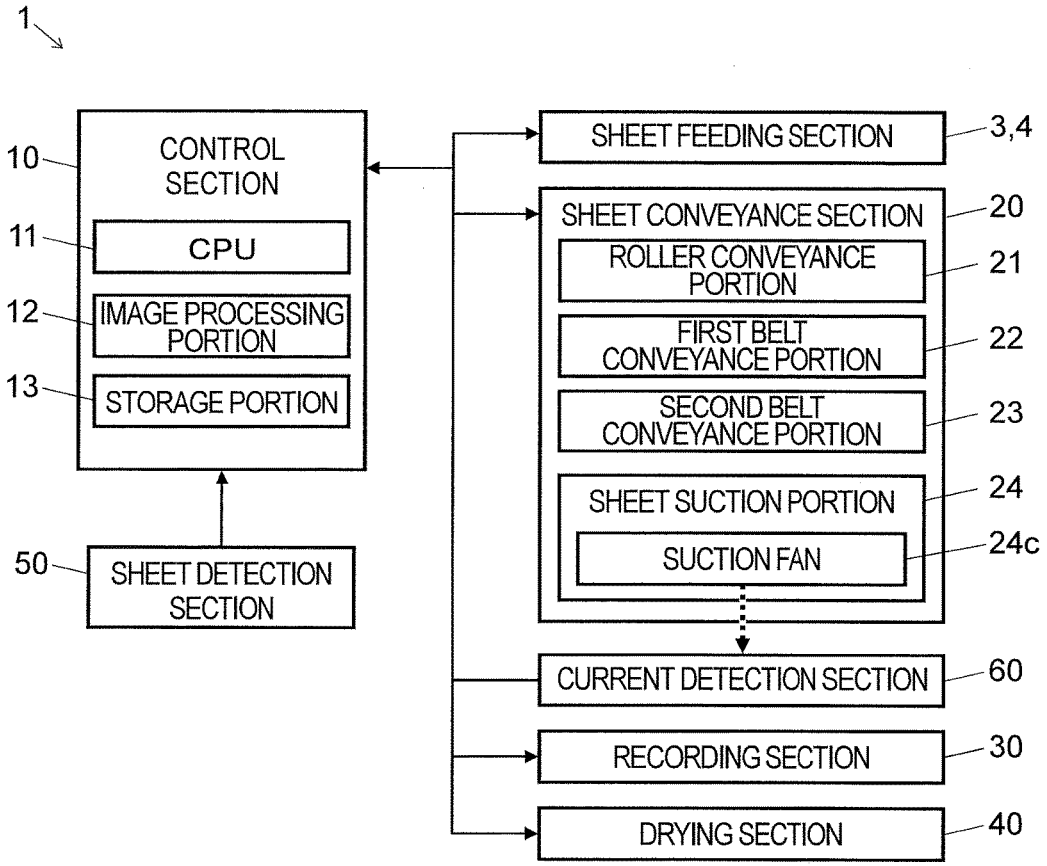
FIG. 2 is a block diagram illustrating a configuration of the inkjet recording apparatus according to the first embodiment of the present disclosure.

First, a description will be given of a schematic configuration of an inkjet recording apparatus according to a first embodiment of the present disclosure, with reference to FIG. 1 and FIG. 2. FIG. 1 is an example of front vertical sectional view illustrating a schematic configuration of the inkjet recording apparatus. FIG. 2 is a block diagram illustrating a configuration of the inkjet recording apparatus.

The inkjet recording apparatus 1 illustrated in FIG. 1 and FIG. 2, which employs an inkjet recording method, is what is called a printer. The inkjet recording apparatus 1 includes a sheet feeding cassette 3 and a manual sheet feeding tray 4 as a sheet feeding section for feeding a sheet P as a recording medium.

The sheet feeding cassette 3 is disposed at a lower portion of an inside of a main body 2 of the inkjet recording apparatus 1. The manual sheet feeding tray 4 is disposed on an outer right side surface of the main body 2. The sheet feeding cassette 3 and the manual sheet feeding tray 4 each accommodate a plurality of sheets P, and feed them to a sheet conveyance section 20 separately one by one during printing.

The sheet conveyance section 20 is disposed on a downstream side of the sheet feeding cassette 3 and the manual sheet feeding tray 4 with respect to a sheet conveyance direction. The sheet conveyance section 20 includes a roller conveyance portion 21, a first belt conveyance portion 22, and a second belt conveyance portion 23. The roller conveyance portion 21 conveys the sheet P by nipping it in a nip portion of a pair of rollers which contact each other by being pressed against each other. The first belt conveyance portion 22 and the second belt conveyance portion 23 adsorb, hold, and convey the sheet P on upper surfaces thereof, which are respectively a sheet conveyance surface of a first conveyance belt 22*a* and a sheet conveyance surface of a second conveyance belt 23*a*. The sheet conveyance section 20 conveys the sheet P fed out from the sheet feeding cassette 3 or the manual sheet feeding tray 4 to a recording section 30 and a drying section 40, and further discharges the sheet P into a sheet discharge tray 5 after recording and drying operations are performed with respect to the sheet P.

The sheet conveyance section 20 includes a switching portion 6 on an upstream side of the sheet discharge tray 5 with respect to the sheet conveyance direction. In a case where two-side printing is to be performed, the sheet P is conveyed from the switching portion 6 to a sheet turning-over portion 7, which is disposed above the recording section 30 and the drying section 40. Through the sheet turning-over portion 7, the conveyance direction of the sheet P is switched to turn it upside down, and then the sheet P is conveyed through an upper portion of the main body 2, and then conveyed back to an upstream side of the recording section 30.

The sheet conveyance section 20 includes a registration roller pair 8, which is disposed on the upstream side of the recording section 30 with respect to the sheet conveyance direction. The registration roller pair 8 corrects oblique feeding of the sheet P and, with timing coordinated with an ink ejecting operation executed by the recording section 30, feeds out the sheet P toward the first belt conveyance portion 22.

The recording section 30 is disposed over the first belt conveyance portion 22 so as to face the sheet P conveyed by the first belt conveyance portion 22. The recording section 30 includes recording heads 32K, 32Y, 32M, and 32C, which are line-type inkjet heads corresponding to four colors of black, yellow, magenta, and cyan, respectively (see FIG. 3). The recording section 30 ejects ink onto the sheet P conveyed by being adsorbed and held on the first conveyance belt 22*a*, sequentially from the recording heads 32K, 32Y, 32M, and 32C, to thereby record a full color image in which black, yellow, magenta and cyan inks are superimposed. Further, with the inkjet recording apparatus 1, it is also possible to record a monochrome image.

The drying section 40 is arranged on a downstream side of the recording section 30 with respect to the sheet conveyance direction, and the second belt conveyance portion 23 is disposed under the drying section 40. After having an ink image recorded thereon at the recording section 30, the sheet P is conveyed under the drying section 40 by being adsorbed and held on the second conveyance belt 23*a*, during which ink on the sheet P is dried by the drying section 40.

At a position on a downstream side of the drying section 40 with respect to the sheet conveyance direction, near a left side surface of the main body 2, there is disposed a decurler portion 9. The sheet P, having the ink thereon dried at the drying section 40, is sent to the decurler portion 9, where curling caused in the sheet P is corrected.

The inkjet recording apparatus 1 further includes a control section 10. The control section 10 includes a CPU 11, an image processing portion 12, a storage portion 13, and other unillustrated electronic components and circuits. The CPU 11 controls operations of various components of the inkjet recording apparatus 1, such as the sheet conveyance section 20 and the recording section 30, based on control programs and data stored in the storage portion 13, and performs recording processing with respect to the sheet P. The image processing portion 12 performs, with respect to image data received from an external computer, image processing for realizing suitable recording. The storage portion 13 comprises, for example, a combination of a non-volatile storage device, such as a program ROM and a data ROM, and a volatile storage device, such as a RAM, of which none is illustrated.

Figure 3:
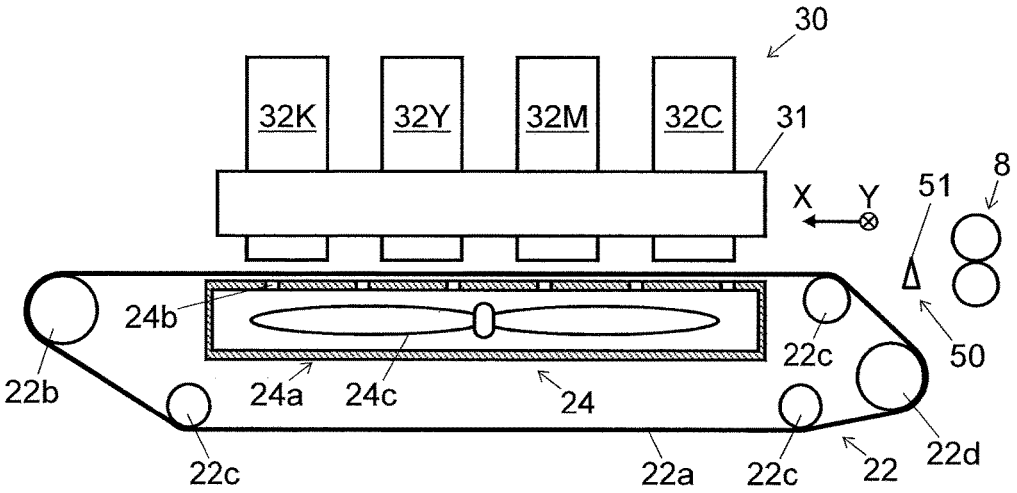
FIG. 3 is a front view of a recording section and the vicinity thereof in the inkjet recording apparatus according to the first embodiment of the present disclosure.
Figure 4:
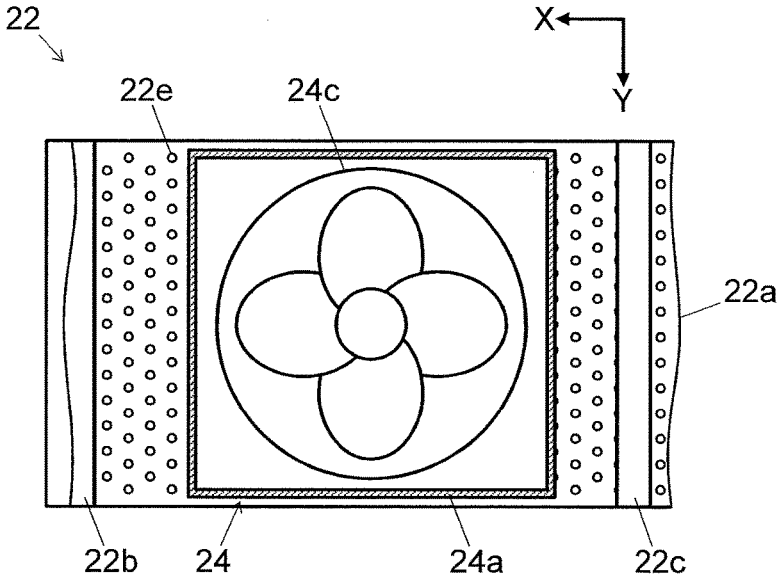
FIG. 4 is a bottom view of the recording section and the vicinity thereof in the inkjet recording apparatus according to the first embodiment of the present disclosure.

Next, detailed configurations of the recording section 30 and the vicinity thereof will be described with reference to FIG. 3 and FIG. 4, in addition to FIG. 1 and FIG. 2. FIG. 3 and FIG. 4 are a front view and a bottom view, respectively, of the recording section 30 and the vicinity thereof. In FIG. 3 and FIG. 4, arrow X indicates the sheet conveyance direction, in which sheets P are conveyed, and arrow Y indicates the sheet width direction of sheets P, which is perpendicular to the sheet conveyance direction.

The first belt conveyance portion 22 includes, in addition to the first conveyance belt 22*a*, a drive roller 22*b*, a driven roller 22*c*, and a tension roller 22*d*. The first conveyance belt 22*a* is an endless belt wound around the drive roller 22*b*, the driven roller 22*c*, and the tension roller 22*d*. The first conveyance belt 22*a* is caused by the drive roller 22*b* to rotate in a counterclockwise direction in FIG. 3. The sheet P fed out from the registration roller pair 8 is conveyed from right to left in FIG. 3 in a state of being adsorbed and held on an upper surface of the first conveyance belt 22*a*, and passes under the recording section 30.

Inside the first conveyance belt 22*a*, at a position facing a side (back side) opposite from the sheet conveyance surface of the first conveyance belt 22*a*, a sheet suction portion 24 is disposed. The sheet suction portion 24 includes a large number of holes 24*b*, which are formed in a top surface of a housing 24*a* thereof to penetrate the top surface to allow communication between inside and outside of the housing 24*a*, and further, inside the housing 24*a*, there is provided, for example, a single suction fan 24*c*. Further, the first conveyance belt 22*a* also includes a large number of suction holes 22*e* for air suction, which penetrate the first conveyance belt 22*a* in its thickness direction. The suction fan 24*c* sucks in air via the through holes 24*b* and the suction holes 22*e*, and thereby causes the sheet P to be adsorbed onto the first conveyance belt 22*a*. With this configuration, the first belt conveyance portion 22 conveys the sheet P with the sheet P adsorbed and held on the top surface, that is to say, the sheet conveyance surface, of the first conveyance belt 22*a*.

The recording section 30 includes a head housing 31, in addition to the recording heads 32K, 32Y, 32M, and 32C. The recording heads 32K, 32Y, 32M, and 32C are held by the head housing 31. The recording heads 32K, 32Y, 32M, and 32C each have a shape extending along the sheet width direction, and the four recording heads are arranged in one line along the sheet conveyance direction. Note that the recording heads 32 have the same basic structure, and thus the color identification signs will sometimes be omitted.

The recording heads 32 are supported over the first conveyance belt 22*a*, at a predetermined distance (1 mm, for example) from the sheet conveyance surface of the first conveyance belt 22*a*. The recording heads 32 each have a recording region, which is as wide as or wider than the width of the sheet P conveyed by the first conveyance belt 22*a*, with respect to the sheet width direction.

Each of the recording heads 32 includes a plurality of ink ejection nozzles (not shown) provided in an ink ejection portion thereof, which is a bottom portion thereof. The plurality of ink ejection nozzles are arranged along the sheet width direction such that they are able to eject ink over the whole recording region. The ink ejection nozzles of the respective colors sequentially receive supply of ink from unillustrated ink tanks.

On an upstream side of the recording section 30 with respect to the sheet conveyance direction, at a position on a sheet conveyance path between the recording section 30 and the registration roller pair 8, there is disposed a sheet detection section 50. The sheet detection section 50 has an actuator 51 and an unillustrated transmissive optical sensor, for example. The actuator 51 swings when it contacts the sheet P passing through the sheet conveyance path. The optical sensor detects the actuator 51 swinging to block the optical path. The sheet detection section 50 detects the presence/absence of the sheet P sent out from the sheet feeding cassette 3 or the manual sheet feeding tray 4.

The inkjet recording apparatus 1 further includes a current detection section 60. The current detection section 60 may be configured to detect a current as a voltage by using a shunt resistor, for example, or may use a Hall element or a current transformer. The current detection section 60 detects a drive current applied to the suction fan 24*c*.

The control section 10, by using the sheet detection section 50 and the current detection section 60, executes sheet conveyance processing by the first belt conveyance portion 22 and recording processing by the recording section 30.

Figure 5:
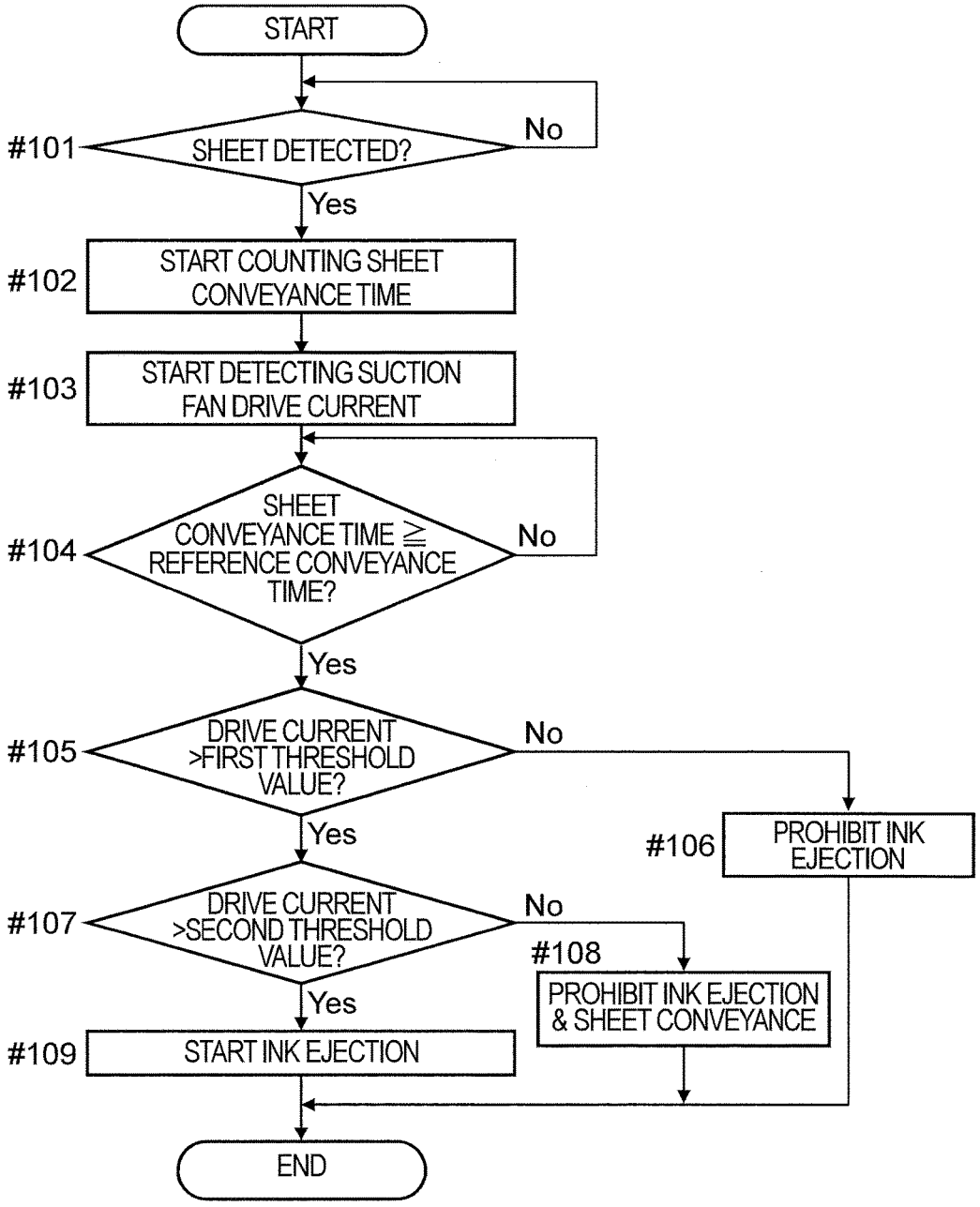
FIG. 5 is a flowchart illustrating an example of sheet conveyance processing and recording processing performed in the inkjet recording apparatus according to the first embodiment of the present disclosure.

Next, descriptions will be given of the sheet conveyance processing by the first belt conveyance portion 22 and the recording processing by the recording section 30, with reference to FIG. 5, in addition to FIG. 1 to FIG. 4. FIG. 5 is a flowchart illustrating an example of sheet conveyance processing and recording processing performed in the inkjet recording apparatus 1.

For the execution of the sheet conveyance processing and the recording processing, the storage portion 13 stores, in a data ROM, previously determined various setting values and conditions related to the operation of the first belt conveyance portion 22 and the operation of the recording section 30. For example, the storage portion 13 stores a reference conveyance time (predetermined time) immediately before arrival of the sheet P at the first belt conveyance portion 22. The reference conveyance time of the sheet P is a theoretical value calculated by using a distance from a sheet detection position by the sheet conveyance section 50 to a detection position of a change of the drive current applied to the suction fan 24*c* by the current detection section 60 and a previously determined sheet conveyance speed.

For example, the storage portion 13 stores a first threshold value and a second threshold value relating to change of the drive current applied to the suction fan 24*c*. The first threshold value is a threshold value used to make a judgment on whether the sheet P has reached the first belt conveyance portion 22. Thus, set as the first threshold value is a current value that is a little larger than a drive current applied to the suction fan 24*c* in what is called an unloaded condition, when the sheet P has not yet reached the first belt conveyance portion 22. The second threshold value is a threshold value used to make a judgment on whether a curl has occurred in the sheet P which has reached the first belt conveyance portion 22. Thus, set as the second threshold value is a current value that is larger than the first threshold value but is smaller than a drive current applied to the suction fan 24*c* when the sheet P is in close contact with all over the sheet conveyance surface of the first conveyance belt 22*a*.

In the inkjet recording apparatus 1, on acceptance of a print job, the sheet conveyance processing by the first belt conveyance portion 22 and the recording processing by the recording section 30 are started (START in FIG. 5).

At step #101, based on information from the sheet detection section 50, the control section 10 makes a judgment on whether the sheet detection section 50 has detected the sheet P. When it is found that the sheet detection section 50 has detected the sheet P, the process proceeds to step #102. When it is found that the sheet detection section 50 has not detected the sheet P, the judgment making on sheet detection at step #101 continues to be repeated.

At step #102, the control section 10 starts counting the sheet conveyance time. The control section 10 counts time passed since the detection of the presence of the sheet P by the sheet detection section 50.

At step #103, the control section 10 starts to detect the drive current applied to the suction fan 24*c*. The control section 10 receives, from the current detection section 60, data related to the drive current applied to the suction fan 24*c* and detects the value of the drive current.

At step #104, the control section 10 makes a judgment on whether the sheet conveyance time has reached the reference conveyance time. When it is found that the sheet conveyance time has reached the reference conveyance time, the process proceeds to step #105. When it is found that the sheet conveyance time has not reached the reference conveyance time, the control section 10 continues to wait for time to pass at step #104.

At step #105, based on information from the current detection section 60, the control section 10 makes a judgment on whether the drive current applied to the suction fan 24*c* exceeds the first threshold value. When it is found that the drive current applied to the suction fan 24*c* does not exceed the first threshold value, the process proceeds to step #106. When it is found that the drive current applied to the suction fan 24*c* exceeds the first threshold value, the process proceeds to step #107.

At step #106, that is, in the case where the drive current applied to the suction fan 24*c* does not exceed the first threshold value, it can be assumed that the sheet P has not been appropriately conveyed to the first belt conveyance portion 22. Based on this assumption, the control section 10 prohibits the recording section 30 from ejecting ink. Accordingly, it becomes possible to effectively reduce occurrence of a sheet-conveyance related inconvenience of the soiling of the sheet conveyance path with ink ejected unintendedly when the sheet P has not reached the recording region yet. And, the sheet conveyance processing and the recording processing are stopped (END in FIG. 5). At this time, a notification may be given to the user, by using an unillustrated display section or the like, to the effect that the sheet conveyance processing and the recording processing have been stopped.

At step #107, based on information from the current detection section 60, the control section 10 makes a judgment on whether the drive current applied to the suction fan 24*c* exceeds the second threshold value. When it is found that the drive current applied to the suction fan 24*c* does not exceed the second threshold value, the process proceeds to step #108. When it is found that the drive current applied to the suction fan 24*c* exceeds the second threshold value, the process proceeds to step #109.

At step #108, that is, in the case where the drive current applied to the suction fan 24*c* does not exceed the second threshold value, it can be assumed that a curl has occurred in the sheet P conveyed to the first belt conveyance portion 22 and thus the sheet P is not in close contact with the sheet conveyance surface of the first conveyance belt 22*a*. Based on this assumption, the control section 10 prohibits the recording section 30 from ejecting ink, and further prohibits the first belt conveyance portion 22 from conveying the sheet P. Accordingly, it becomes possible to effectively reduce occurrence of sheet-conveyance related inconveniences such as the soiling of the sheet conveyance path with ink ejected unintendedly, a sheet jam, and further, damage to a nozzle due to the sheet P contacting the nozzle when a curl has occurred in the sheet P. And, the sheet conveyance processing and the recording processing are stopped (END in FIG. 5). At this time, a notification may be given to the user, by using an unillustrated display section or the like, that the sheet conveyance processing and the recording processing have been stopped.

At step #109, that is, in the case where the drive current applied to the suction fan 24*c* exceeds both the first threshold value and the second threshold value, it can be assumed that the sheet P has been appropriately conveyed to the first belt conveyance portion 22 and is also in close contact with the sheet conveyance surface of the first conveyance belt 22*a*. Based on this assumption, the control section 10 makes the recording section 30 start ejecting ink. And, the sheet conveyance processing and the recording processing are appropriately finished (END in FIG. 5).

Second Embodiment

Figure 6:
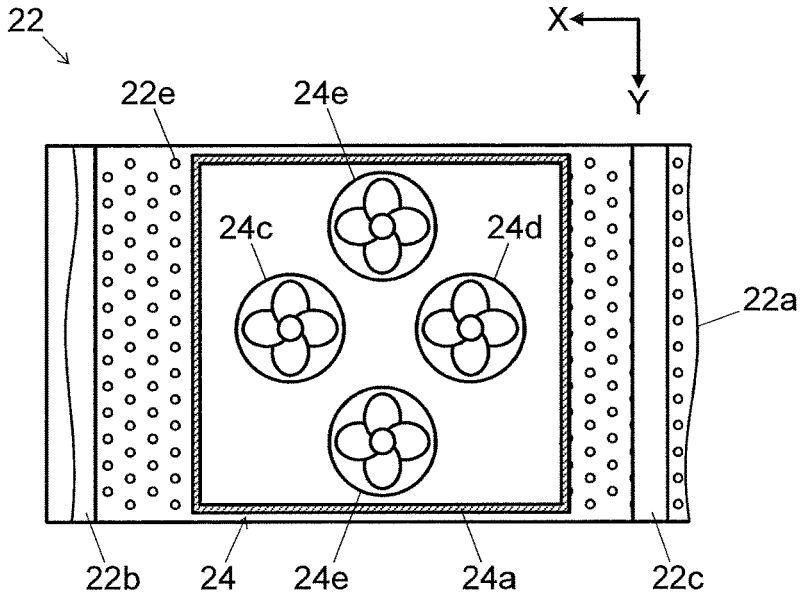
FIG. 6 is a bottom view of a recording section and the vicinity thereof in an inkjet recording apparatus according to a second embodiment of the present disclosure.

Next, an inkjet recording apparatus according to a second embodiment of the present disclosure will be described with reference to FIG. 6. FIG. 6 is a bottom view of the recording section and the vicinity thereof in the inkjet recording apparatus. The configuration in this embodiment is basically the same as that in the first embodiment discussed above; accordingly, such components as are found also in the first embodiment are identified by common reference signs or part names, and overlapping description thereof will occasionally be omitted.

In the inkjet recording apparatus 1 of the second embodiment, the sheet conveyance section 20 includes a sheet suction portion 24 illustrated in FIG. 6. The sheet suction portion 24 includes a total of four suction fans 24*c*, 24*d*, and 24*e*. The two suction fans 24*e* are arranged, in a substantially central portion of the sheet suction portion 24 in the sheet conveyance direction (arrow X direction in FIG. 6), side by side along the sheet width direction (arrow Y direction in FIG. 6).

The suction fans 24*c* and 24*d* are arranged, in a substantially central portion of the sheet suction portion 24 in the sheet width direction, side by side along the sheet conveyance direction. The current detection section 60 is capable of separately detecting a drive current applied to each of the suction fans 24*c* and 24*d*.

After passage of the reference conveyance time since the detection of the presence of the sheet P performed by the sheet detection section 50, the control section 10 sequentially makes a judgment on whether drive currents applied to the suction fans exceed the first threshold value, starting with the suction fan 24*d*, which is disposed on the upstream side in the sheet conveyance direction. When it is found that either the drive current applied to the suction fan 24*d* or the drive current applied to the suction fan 24*c* does not exceed the first threshold value, the control section 10 prohibits the recording 30 from ejecting ink.

With this configuration, it is possible to detect a situation where the sheet P is not appropriately conveyed, separately at a plurality of positions, namely, at the position of the suction fan 24*d* and at the position of the suction fan 24*c*. This makes it possible to prohibit the recording section 30 from ejecting ink to deal also with such a case, for example, where the sheet P appropriately conveyed to an upstream portion of the first belt conveyance portion 22 is separated from the sheet conveyance surface of the first conveyance belt 22*a* in a downstream portion of the first conveyance portion 22. Accordingly, it becomes possible to further effectively reduce occurrence of the sheet-conveyance related inconvenience of the soiling of the sheet conveyance path with ink ejected unintendedly.

Furthermore, by prohibiting the recording section 30 from ejecting ink when the drive current applied to the suction fan 24*d*, which is the one of the plurality of suction fans that is disposed on the most upstream side in the sheet conveyance direction, does not exceed the first threshold value, it is possible to quickly deal with a situation where the sheet P is not appropriately conveyed toward the first belt conveyance portion 22.

Third Embodiment

Figure 7:
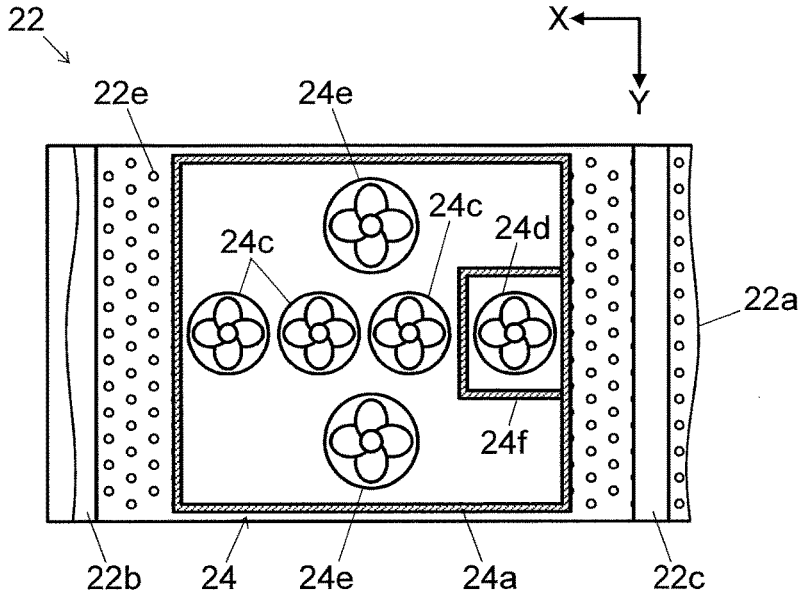
FIG. 7 is a bottom view of a recording section and the vicinity thereof in an inkjet recording apparatus according to a third embodiment of the present disclosure.

Next, an inkjet recording apparatus according to a third embodiment of the present disclosure will be described with reference to FIG. 7. FIG. 7 is a bottom view of the recording section and the vicinity thereof in the inkjet recording apparatus. The basic configuration of the present embodiment is the same as those of the first and second embodiments described above, and thus such components as are common to those embodiments are identified with the same reference signs as those used in the first and second embodiments, and overlapping descriptions thereof may sometimes be omitted.

In the inkjet recording apparatus 1 of the third embodiment, the sheet conveyance section 20 includes a sheet suction portion 24 illustrated in FIG. 7. The sheet suction portion 24 includes a total of six suction fans 24*c*, 24*d*, and 24*e*. The two suction fans 24*e* are arranged, in a substantially central portion of the sheet suction portion 24 in the sheet conveyance direction (arrow X direction in FIG. 7), side by side along the sheet width direction (arrow Y direction in FIG. 7).

The three suction fans 24*c* and the suction fan 24*d* are arranged, in a substantially central portion of the sheet suction portion 24 in the sheet width direction, side by side along the sheet conveyance direction. The suction fan 24*d*, which is arranged at the most upstream side in the sheet conveyance direction, is surrounded by a partition wall 24*f*. The suction fan 24*d* is configured such that its air suction path is separated from those of the suction fans 24*c* and 24*e*.

With this configuration, it is possible to improve accuracy in detecting the drive current applied to the suction fan 24*d* in a region of the first belt conveyance portion 22 that the sheet P first reaches in the first belt conveyance portion 22. Accordingly, it becomes possible to accurately detect a situation where the sheet P is not conveyed appropriately.

Fourth Embodiment

Figure 8:
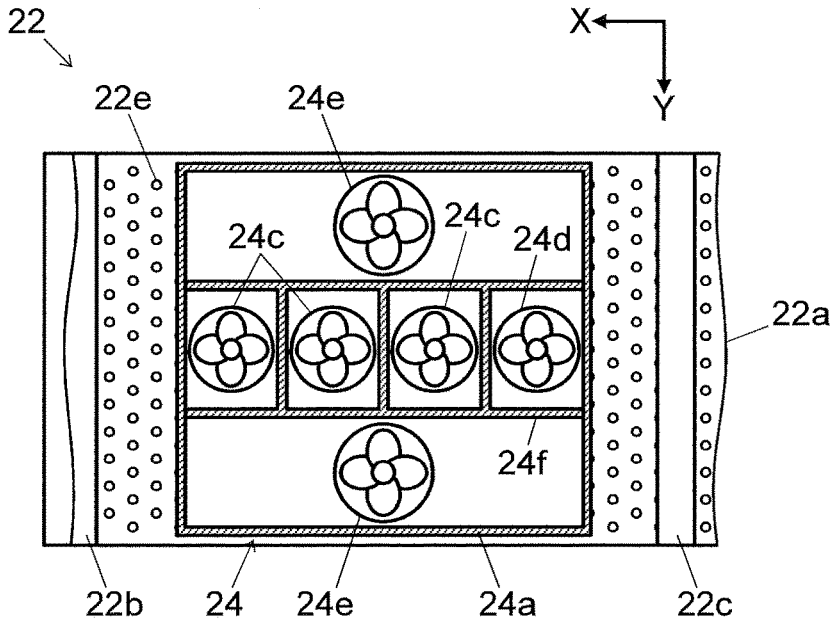
FIG. 8 is a bottom view of a recording section and the vicinity thereof in an inkjet recording apparatus according to a fourth embodiment of the present disclosure.

Next, an inkjet recording apparatus according to a fourth embodiment of the present disclosure will be described with reference to FIG. 8. FIG. 8 is a bottom view of the recording section and the vicinity thereof in the inkjet recording apparatus. The basic configuration of the present embodiment is the same as those of the first to third embodiments described above, and thus such components as are common to those embodiments are identified with the same reference signs as those used in the first and second embodiments, and overlapping descriptions thereof may sometimes be omitted.

In the inkjet recording apparatus 1 of the fourth embodiment, the sheet conveyance section 20 includes a sheet suction portion 24 illustrated in FIG. 8. The sheet suction portion 24 includes a total of six suction fans 24*c*, 24*d*, and 24*e*.

The three suction fans 24*c* and the suction fan 24*d* are arranged, in a substantially central portion of the sheet suction portion 24 in the sheet width direction, side by side along the sheet conveyance direction. The suction fans 24*c* and 24*d* are each surrounded by a partition wall 24*f*. The suction fans 24*c* and 24*d* are configured such that their air suction paths are each separated from those of the other suction fans.

With this configuration, it is possible to separately improve accuracy in detecting the drive current applied to each of the suction fans 24*c* and 24*d*. Accordingly, it becomes possible to accurately detect a situation where the sheet P is not conveyed appropriately separately at each of the positions of the suction fans 24*c* and 24*d*.

It should be understood that the embodiments of the present disclosure described above are in no way meant to limit its scope; the present disclosure can be implemented with any modifications made without departing from its spirit.

For example, the number, and the arrangement, of the plurality of suction fans 24*c*, 24*d*, and 24*e* in the above embodiments are not meant as limitations. Other configurations may be adopted which are different in the number and the arrangement of suction fans from those illustrated in FIGS. 6 to 8.

What is claimed is:

1. An inkjet recording apparatus comprising:

a conveyance section which has a conveyance belt provided with a plurality of suction holes used for adsorbing a recording medium on the conveyance belt and movable along a recording-medium conveyance direction, and which conveys the recording medium;

a recording section which is disposed to face the recording medium conveyed by the conveyance section, and which ejects ink onto the recording medium;

a suction fan which is disposed facing a surface of the conveyance belt opposite from a recording-medium conveyance surface of the conveyance belt, and which sucks in air via the plurality of suction holes to thereby cause the recording medium to be adsorbed on the conveyance belt;

a current detection section for detecting a drive current applied to the suction fan;

a recording-medium detection section which is disposed on an upstream side of the conveyance section with respect to the recording-medium conveyance direction, and which is provided for detecting presence/absence of the recording medium; and a control section which controls operations of the conveyance section, the recording section, and the suction fan, wherein after passage of a predetermined time since detection of presence of the recording medium performed by the recording-medium detection section, the control section makes a judgment on whether a drive current detected by the current detection section exceeds a first threshold value determined in advance, and in a case where the drive current does not exceed the first threshold value, the control section prohibits the recording section from ejecting ink.

2. The inkjet recording apparatus according to claim 1, wherein the suction fan includes a plurality of suction fans arranged along the recording-medium conveyance direction, the current detection section separately detects a drive current applied to each of the plurality of suction fans, and the control section sequentially makes a judgment on whether a drive current applied to each of the plurality of suction fans exceeds the first threshold value determined in advance, starting with the drive current applied to a suction fan of the plurality of suction fans that is disposed on an upstream side in the recording-medium conveyance direction, and in a case where a drive current applied to any of the plurality of suction fans does not exceed the first threshold value, the control section prohibits the recording section from ejecting ink.

3. The inkjet recording apparatus according to claim 2, wherein in a case where a drive current applied to a suction fan of the plurality of suction fans that is disposed on a most upstream side in the recording-medium conveyance direction does not exceed the first threshold value, the control section prohibits the recording section from ejecting ink.

4. The inkjet recording apparatus according to claim 3, wherein the suction fan that is disposed on the most upstream side in the recording-medium conveyance direction has an air suction path which is separated from air suction paths of other ones of the plurality of suction fans.

5. The inkjet recording apparatus according to claim 1, wherein in a case where a drive current detected by the current detection section does not exceed a second threshold value which is larger than the first threshold value, the control section prohibits the recording section from ejecting ink, and further prohibits the conveyance section from conveying the recording medium.

* * * * *